US009731507B2

(12) United States Patent
Togashi

(10) Patent No.: US 9,731,507 B2
(45) Date of Patent: Aug. 15, 2017

(54) LIQUID EJECTING HEAD, LIQUID EJECTING HEAD UNIT, AND LIQUID EJECTING APPARATUS

(71) Applicant: SEIKO EPSON CORPORATION, Tokyo (JP)

(72) Inventor: Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/190,853

(22) Filed: Jun. 23, 2016

(65) Prior Publication Data

US 2016/0303852 A1 Oct. 20, 2016

Related U.S. Application Data

(63) Continuation of application No. 14/557,189, filed on Dec. 1, 2014, now Pat. No. 9,403,362.

(30) Foreign Application Priority Data

Dec. 6, 2013 (JP) ..... 2013-253530

(51) Int. Cl.
*B41J 2/14* (2006.01)
*B41J 2/155* (2006.01)
*B41J 2/16* (2006.01)

(52) U.S. Cl.
CPC ..... *B41J 2/1433* (2013.01); *B41J 2/14233* (2013.01); *B41J 2/155* (2013.01);
(Continued)

(58) Field of Classification Search
CPC ..... B41J 2002/14443
See application file for complete search history.

(56) References Cited

U.S. PATENT DOCUMENTS 6,206,499 B1 * 3/2001 Iijima ..... B41J 2/14024 347/20
7,131,716 B2 * 11/2006 Yamada ..... B41J 2/14209 347/47

(Continued)

FOREIGN PATENT DOCUMENTS

JP 2006-062373 3/2006
JP 2007-160566 6/2007

OTHER PUBLICATIONS

U.S. Appl. No. 14/557,189, Dec. 10, 2015, Office Action.
U.S. Appl. No. 14/557,189, Mar. 31, 2016, Notice of Allowance.

*Primary Examiner* — Geoffrey Mruk
(74) *Attorney, Agent, or Firm* — Workman Nydegger

(57) ABSTRACT

A liquid ejecting head includes: a head main body for ejecting liquid from nozzle openings on a liquid ejecting surface provided with the plurality of nozzle openings; a maintaining member which is adhered to the head main body at a surface side opposite to the liquid ejecting surface side of the head main body in a direction perpendicular to the liquid ejecting surface; and a fixing board which is provided at a side opposite to the maintaining member with respect to the head main body. The fixing board includes a bending portion which is bent to the head main body side. The bending portion is adhered to a side surface of the maintaining member. The head main body is disposed in a space formed by adhering the maintaining member and the fixing board to each other.

20 Claims, 8 Drawing Sheets

(52) U.S. Cl.
CPC ..... *B41J 2/161* (2013.01); *B41J 2/1623* (2013.01); *B41J 2002/14362* (2013.01); *B41J 2002/14419* (2013.01); *B41J 2002/14443* (2013.01); *B41J 2202/19* (2013.01); *B41J 2202/20* (2013.01)

(56) References Cited

U.S. PATENT DOCUMENTS

| | | | |
|---|---|---|---|
| 2002/0024568 | A1 | 2/2002 | Ito et al. |
| 2007/0132815 | A1 | 6/2007 | Sakaida |
| 2015/0158296 | A1 | 6/2015 | Togashi |

* cited by examiner

LIQUID EJECTING HEAD, LIQUID EJECTING HEAD UNIT, AND LIQUID EJECTING APPARATUS

CROSS REFERENCES TO RELATED APPLICATIONS

This application is a continuation application of U.S. patent application Ser. No. 14/557,189, filed Dec. 1, 2014, which patent application is incorporated herein by reference in its entirety. U.S. patent application Ser. No. 14/557,189 claims the benefit of and priority to Japanese Patent Application No. 2013-253530 filed on Dec. 6, 2013, the contents of which are hereby incorporated herein by reference.

BACKGROUND

1. Technical Field

The present invention relates to a liquid ejecting head which ejects liquid from nozzle openings, liquid ejecting head unit which includes the liquid ejecting head, and a liquid ejecting apparatus, and particularly relates to an ink jet type recording head which ejects ink as the liquid, an ink jet type recording head unit, and an ink jet type recording apparatus.

2. Related Art

An ink jet type recording head which is an example of a liquid ejecting head has been proposed to include a head main body which ejects ink droplets from nozzle openings according to a pressure change of a pressure generation section, and a maintaining member which is adhered to a side opposite to a liquid ejecting surface on which the nozzle openings of the head main body are formed (for example, refer to JP-A-2006-62373).

However, there is a problem in that an adhesive which adheres the head main body and the maintaining member to each other allows permeation of moisture included in the ink and evaporation of the moisture included in the ink.

In addition, the problem exists not only in the ink jet type recording head, but also similarly in the liquid ejecting head unit which ejects liquid other than the ink.

SUMMARY

An advantage of some aspects of the invention is to provide a liquid ejecting head, a liquid ejecting head unit, and a liquid ejecting apparatus, which can suppress evaporation of moisture included in liquid from an adhering area of stacked members.

Aspect 1

According to an aspect of the invention, a liquid ejecting head includes: a head main body which ejects liquid from a plurality of nozzle openings on a liquid ejecting surface provided with the plurality of nozzle openings; a maintaining member which is adhered to the head main body at a surface side opposite to the liquid ejecting surface side of the head main body in a direction perpendicular to the liquid ejecting surface; and a fixing board which is provided at a side opposite to the maintaining member with respect to the head main body. The fixing board includes a bending portion which is bent to the head main body side. The bending portion is adhered to a side surface of the maintaining member. The head main body, which is disposed in a space formed by adhering the maintaining member and the fixing board to each other, is provided in the liquid ejecting head.

According to the aspect, even when an adhesive which adheres the head main body and the maintaining body to each other is a material that allows permeation of moisture included in liquid, by disposing the head main body in the space formed by adhering the maintaining member and the fixing board to each other, it is possible to suppress evaporation of moisture.

In addition, since the fixing board is provided at the side opposite to the maintaining member with respect to the head main body and has the bending portion which is bent to the head main body side, the side surface of the maintaining member may be a surface which is adhered to the bending portion.

Aspect 2

In the bending portion according to Aspect 1, it is preferable that the bending portion be adhered to the maintaining member in a concave portion provided on the side surface of the maintaining member. Accordingly, it is possible to simplify a process of adhering the bending portion and the maintaining member to each other, and to accommodate irregularity of a bending amount of the bending portion in the concave portion. In addition, it is possible to reduce a protruding amount of the bending portion from the concave portion in a direction in which the liquid ejecting heads are provided in parallel, by the concave portion. Therefore, for example, it is possible to further narrow an interval between the adjacent liquid ejecting heads.

Aspect 3

In addition, in the maintaining member according to Aspect 1 or 2, it is preferable that the maintaining member have leg portions at both sides of the head main body and the leg portions be adhered to the fixing board at the liquid ejecting surface side of the leg portions. Accordingly, rigidity is improved in a direction in which the fixing board and the maintaining member are stacked.

Aspect 4

In addition, according to Aspect 3, it is preferable that a plurality of head main bodies be provided and the leg portions be provided in a direction perpendicular to a direction in which the plurality of head main bodies are provided among in-plane directions of the liquid ejecting surface. Accordingly, even when there is the plurality of head main bodies, it is possible to improve the rigidity in the direction in which the fixing board and the maintaining member are stacked. In addition, in the direction in which the plurality of head main bodies are provided in parallel among the in-plane directions of the liquid ejecting surface, even when a structure, such as the leg portion, is provided or not provided, it is possible to improve the rigidity in the direction in which the fixing board and the maintaining member are stacked.

Aspect 5

In addition, in the maintaining member according to Aspects 1 to 4, it is preferable that the maintaining member have an opening which communicates with the space and the bending portion seal the opening. Accordingly, as the space communicates with the opening in a parallel direction, it is possible to reduce the number of structures in the space. For example, even when the liquid ejecting heads are provided in parallel, by shortening the interval between the adjacent liquid ejecting heads, it is possible to provide the nozzle openings to be close to each other. In addition, since the nozzle openings of the adjacent liquid ejecting heads can be provided to be close to each other, it is possible to provide the liquid ejecting heads in parallel on a straight line, and to narrow a width in the direction perpendicular to the direction in which the liquid ejecting heads of the liquid ejecting head unit are provided in parallel.

Aspect 6

In addition, according to Aspect 5, it is preferable that the plurality of head main bodies be provided and the openings be provided at both sides of the maintaining member in the direction in which the plurality of head main bodies are provided among the in-plane directions of the liquid ejecting surface. Accordingly, even when there is the plurality of head main bodies, it is possible to reduce the number of structures in the space.

Aspect 7

In addition, according to Aspects 1 to 6, it is preferable that the plurality of head main bodies be adhered to the maintaining member and the plurality of head main bodies be maintained in the space formed by adhering the maintaining member and the fixing board to each other. Accordingly, it is possible to accommodate the irregularity in height of the plurality of head main bodies by the adhesive for adhering the maintaining member.

Aspect 8

In addition, according to Aspects 1 to 7, it is preferable that the plurality of head main bodies be provided, the fixing board have a base portion provided with an exposure opening portion for opening the nozzle openings, and the interval from the entire circumference of the base portion to the exposure opening portion be smaller in the direction in which the plurality of head main bodies are provided than that in the direction perpendicular to the direction in which the plurality of head main bodies are provided, among the in-plane directions of the liquid ejecting surface of the base portion. Accordingly, for example, even when the liquid ejecting heads are provided in parallel in the direction in which the head main bodies are provided in parallel, it is possible to shorten the interval of the adjacent liquid ejecting heads and to provide the nozzle openings to be close to each other.

Aspect 9

In addition, according to another aspect of the invention, a liquid ejecting head unit includes: the plurality of liquid ejecting heads which are provided in parallel; and a head fixing substrate which maintains the plurality of liquid ejecting heads provided in parallel. Each of the liquid ejecting heads has: a head main body which ejects liquid from the nozzle openings of a liquid ejecting surface on which the plurality of nozzle openings are provided; a maintaining member which is adhered to the head main body in a direction perpendicular to the liquid ejecting surface at a side opposite to the liquid ejecting surface side of the head main body; and a fixing board which is provided at a side opposite to the maintaining member with respect to the head main body, and has a bending portion bent to the head main body side. The bending portion is adhered to a side surface of the maintaining member adjacent to each other in a direction in which the liquid ejecting heads are provided in parallel.

According to the aspect, even when the adhesive which adheres the head main body and the maintaining member to each other is a material which allows permeation of moisture included in the liquid, by adhering the bending portion of the fixing board and the side surface of the maintaining member to each other, it is possible to suppress evaporation of moisture.

Furthermore, by providing the bending portion adhered to the maintaining member in the direction the liquid ejecting heads are provided in parallel, even when the interval of the adjacent liquid ejecting heads is shortened, and the nozzle openings between the adjacent liquid ejecting heads are provided to be close to each other, it is possible to ensure an area which is necessary for adhering the fixing board on the side surface of the maintaining member. In addition, it is not required to provide a structure, such as a leg portion, in the maintaining member covered by the bending portion, and it is possible to provide the nozzle openings of the adjacent liquid ejecting heads to be close to each other. For this reason, it is possible to provide the liquid ejecting heads in parallel on the straight line, and to narrow the width in the direction perpendicular to the direction in which the liquid ejecting heads of the liquid ejecting head unit is provided in parallel.

Aspect 10

In addition, in the maintaining member according to Aspect 9, it is preferable that the maintaining member have leg portions at both sides of the head main body and the leg portions be adhered to the fixing board at the liquid ejecting surface side of the leg portions. Accordingly, the rigidity is improved in the direction in which the fixing board and the maintaining member are stacked.

Aspect 11

In addition, in the leg portions according to Aspect 10, it is preferable that the leg portions be provided in the direction perpendicular to the direction in which the liquid ejecting heads are provided among the in-plane directions of the liquid ejecting surface. Accordingly, even when the structure, such as the leg portions, is not provided in the direction in which the plurality of liquid ejecting heads is provided in parallel among the in-plane directions of the liquid ejecting surface, it is possible to improve the rigidity in the direction in which the fixing board and the maintaining member are stacked.

Aspect 12

In addition, in the maintaining member according to Aspects 9 to 11, it is preferable that the maintaining member have an opening which communicates with the space and the bending portion seal the opening. Accordingly, as the space communicates with the opening in a parallel direction, it is possible to reduce the number of structures in the space. For this reason, it is possible to shorten the interval of the adjacent liquid ejecting heads and to provide the nozzle openings to be close to each other. In addition, since the nozzle openings of the adjacent liquid ejecting heads can be provided to be close to each other, it is possible to provide the liquid ejecting heads in parallel on the straight line, and to narrow the width in the direction perpendicular to the direction in which the liquid ejecting heads of the liquid ejecting head unit are provided in parallel.

Aspect 13

In addition, according to Aspects 9 to 12, it is preferable that the plurality of head main bodies be adhered to the maintaining member and the plurality of head main bodies be maintained in the space formed by adhering the maintaining member and the fixing board to each other. Accordingly, it is possible to accommodate the irregularity in height of the plurality of head main bodies by the adhesive for adhering the maintaining member.

Aspect 14

In addition, in the fixing board according to Aspects 9 to 13, it is preferable that the fixing board have a base portion provided with an exposure opening portion for opening the nozzle openings and the interval from the entire circumference of the base portion to the exposure opening portion be smaller in the direction in which the plurality of liquid ejecting heads are provided than that in the direction perpendicular to the direction in which the plurality of liquid ejecting heads are provided, among the in-plane directions of the liquid ejecting surface of the base portion. Accordingly, it is possible to shorten the interval of the adjacent liquid ejecting heads and to provide the nozzle openings to be close to each other.

Aspect 15

Furthermore, according to another aspect of the invention, there is provided a liquid ejecting apparatus in which the plurality of liquid ejecting head units according to Aspects 9 to 14 is provided in parallel, and includes a transporting section which relatively transports an ejecting medium to the liquid ejecting head unit in a direction which intersects with the parallel direction among the in-plane directions of the liquid ejecting surface.

According to the aspect, since the width in a transporting direction of the liquid ejecting head unit can be narrowed, it is possible to shorten a transporting interval of the transporting section provided to interpose the liquid ejecting head unit. Therefore, it is possible to fix a posture of the ejecting medium well, and to suppress generation of a landing position shift or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
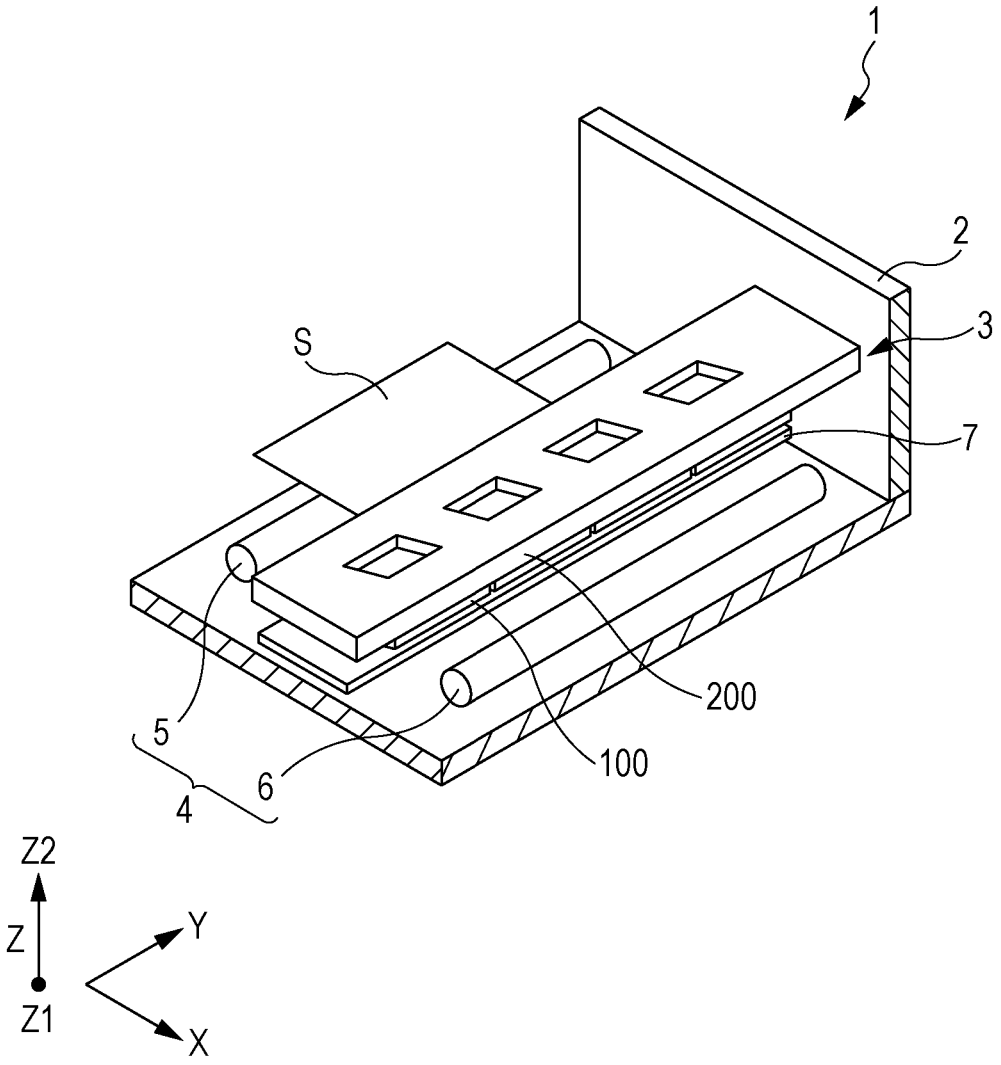
FIG. 1 is a schematic perspective view of a recording apparatus according to Embodiment 1 of the invention.

FIG. 1 is a schematic perspective view of a configuration of an ink jet type recording apparatus which is an example of a liquid ejecting apparatus according to Embodiment 1 of the invention.

The ink jet type recording apparatus which is an example of the liquid ejecting apparatus of the embodiment is a so-called line type recording apparatus in which an ink jet type recording head unit which is an example of a liquid ejecting head unit is fixed and printing is performed by transporting a recording sheet, such as a paper sheet, which is an ejecting medium.

In particular, as illustrated in FIG. 1, an ink jet type recording apparatus 1 includes: an apparatus main body 2; an ink jet type recording head unit 3 (hereinafter, simply referred to as a head unit 3) which has a plurality of ink jet type recording heads 100 and is fixed to the apparatus main body 2; a transporting section 4 which transports a recording sheet S; and a supporting member 7 which supports the recording sheet S facing the head unit 3. In addition, in the embodiment, a transporting direction of the recording sheet S is called a first direction X. In addition, in a in-plane direction in which nozzle openings of the head unit 3 are opened, a direction perpendicular to the first direction X is called a second direction Y. Furthermore, a direction perpendicular to the first direction X and the second direction Y is called a third direction Z. In addition, a liquid ejecting direction side (recording sheet S side with respect to the head unit 3) on the surface including the third direction Z is called a Z1 side, and an opposite side is called a Z2 side.

The head unit 3 includes a plurality of ink jet type recording heads 100 and a head fixing substrate 200 which maintains the plurality of ink jet type recording heads 100.

The plurality of ink jet type recording heads 100 is provided in parallel in a direction which intersects with the first direction X that is the transporting direction, in the embodiment, in the second direction Y which intersects with the first direction X, and is fixed to the head fixing substrate 200. In addition, in the embodiment, the plurality of ink jet type recording heads 100 is provided in parallel on a straight line of the second direction Y. In other words, the plurality of ink jet type recording heads 100 is not disposed to be shifted to the first direction X. Accordingly, it is possible to narrow a width of the head unit 3 in the first direction X, and to make the head unit 3 small.

In addition, the head fixing substrate 200 maintains the plurality of ink jet type recording heads 100 so that nozzle openings 21 of the plurality of ink jet type recording heads 100 face the recording sheet S side, and is fixed to the apparatus main body 2.

The transporting section 4 transports the recording sheet S in the first direction X with respect to the head unit 3. The transporting section 4 includes, for example, a first transporting roller 5 and a second transporting roller 6 which are provided at both sides in the first direction X.

By the first transporting roller 5 and the second transporting roller 6, the recording sheet S is transported. In addition, the transporting section 4 which transports the recording sheet S is not limited to a transporting roller, but may be a belt, a drum, or the like.

The supporting member 7 supports the recording sheet S transported by the transporting section 4 at a position facing the head unit 3. The supporting member 7 is, for example, made of a metal or resin, in which a cross section provided facing the head unit 3 is rectangular between the first transporting roller 5 and the second transporting roller 6.

In addition, in the supporting member 7, an adsorbing section which adsorbs the transported recording sheet S onto the supporting member 7 is provided. Examples of the adsorbing section include a section which sucks and adsorbs by sucking the recording sheet S and a section which electrostatically adsorbs the recording sheet S by an electrostatic force. For example, when the transporting section 4 is a belt or a drum, the supporting member 7 supports the recording sheet S on the belt or the drum at the position facing the head unit 3.

In addition, a liquid storage section (not illustrated), such as an ink tank or an ink cartridge in which the ink is stored, is connected to each of the ink jet type recording heads 100 of the head unit 3 to be able to supply the ink. The liquid storage section, for example, may be maintained on the head unit 3, or may be maintained at a position different from the head unit 3 in the apparatus main body 2. In addition, a flow path for supplying the ink supplied from the liquid storage section to the ink jet type recording head 100, or the like, may be provided inside the head fixing substrate 200, and a flow path member may be provided in addition to the head fixing substrate 200 and the ink from the liquid storage section may be supplied via the flow path member to the ink jet type recording head 100. Obviously, the ink may be supplied directly to the ink jet type recording head 100 without using the head fixing substrate 200 or the flow path member fixed to the head fixing substrate 200 from the liquid storage section.

In the ink jet type recording apparatus 1 of the embodiment, the recording sheet S is transported by the first transporting roller 5, and the printing is performed on the recording sheet S supported on the supporting member 7 by the head unit 3. The printed recording sheet S is transported by the second transporting roller 6.

Figure 2:
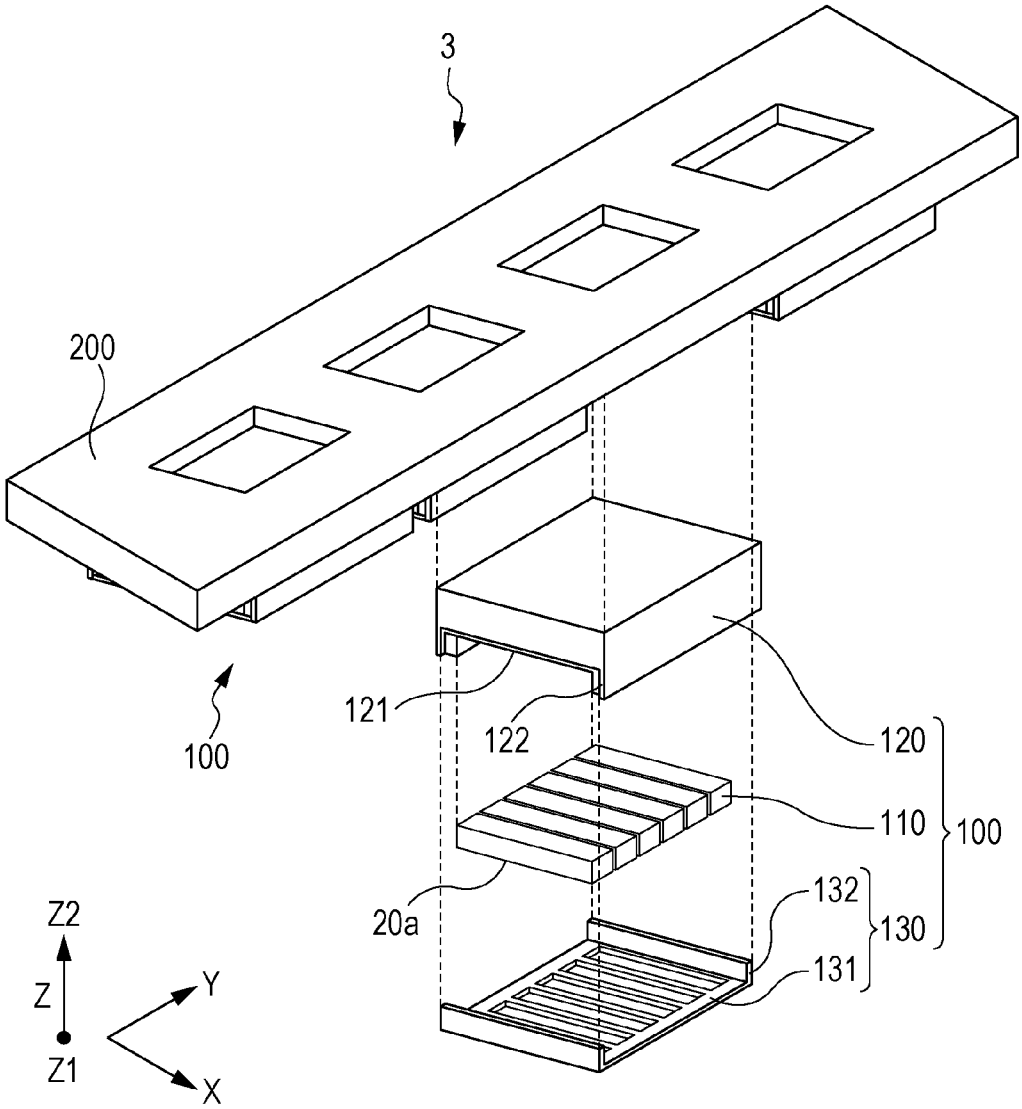
FIG. 2 is a perspective view of a head unit according to Embodiment 1 of the invention.
Figure 3:
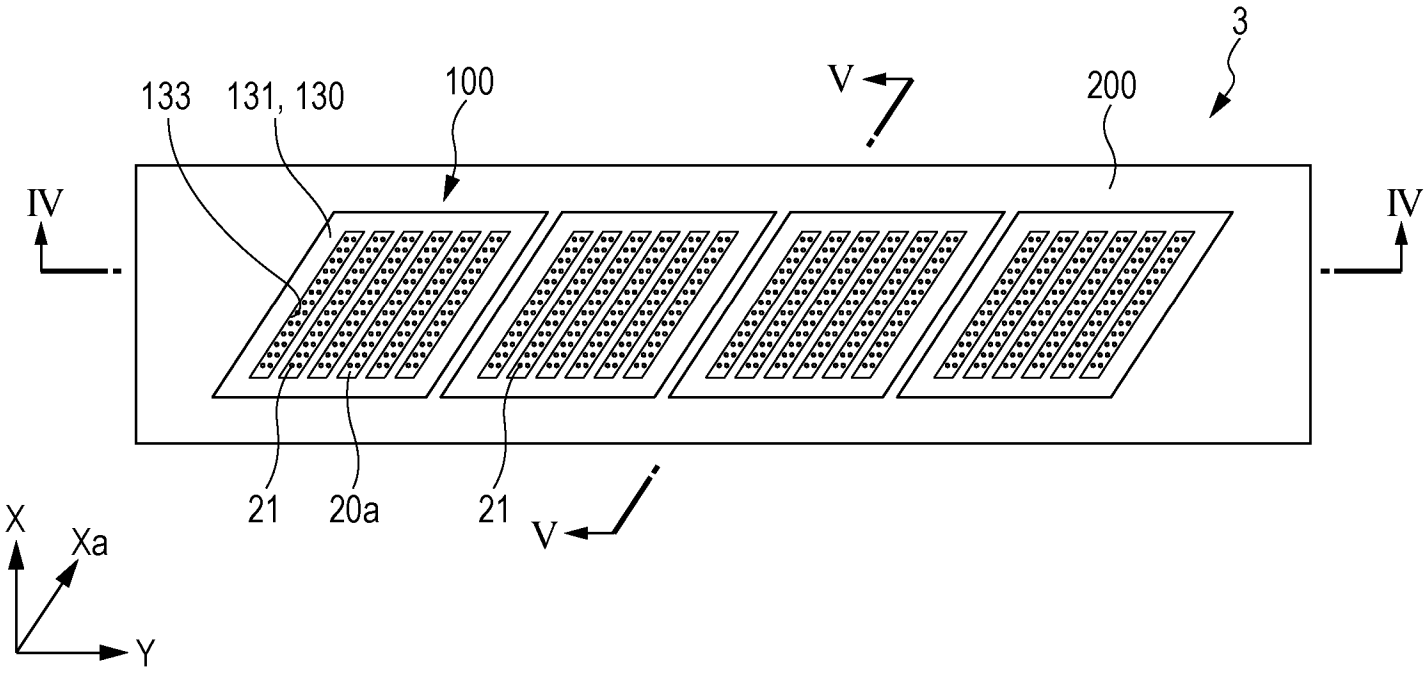
FIG. 3 is a plan view of the head unit according to Embodiment 1 of the invention.
Figure 4A:
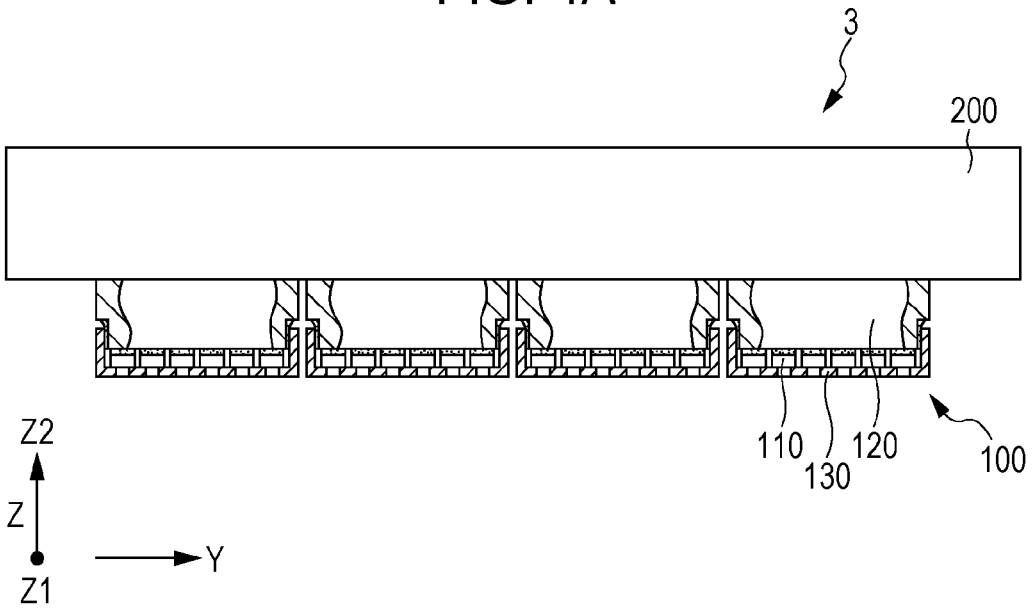
FIGS. 4A and 4B are a cross-sectional view and an enlarged view of the head unit according to Embodiment 1 of the invention.
Figure 4B:
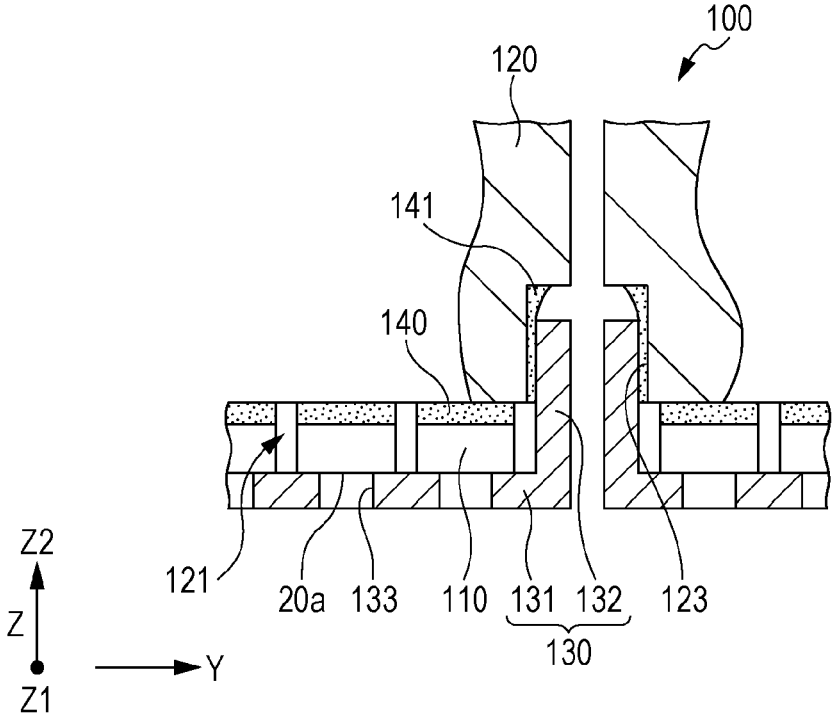
Figure 5:
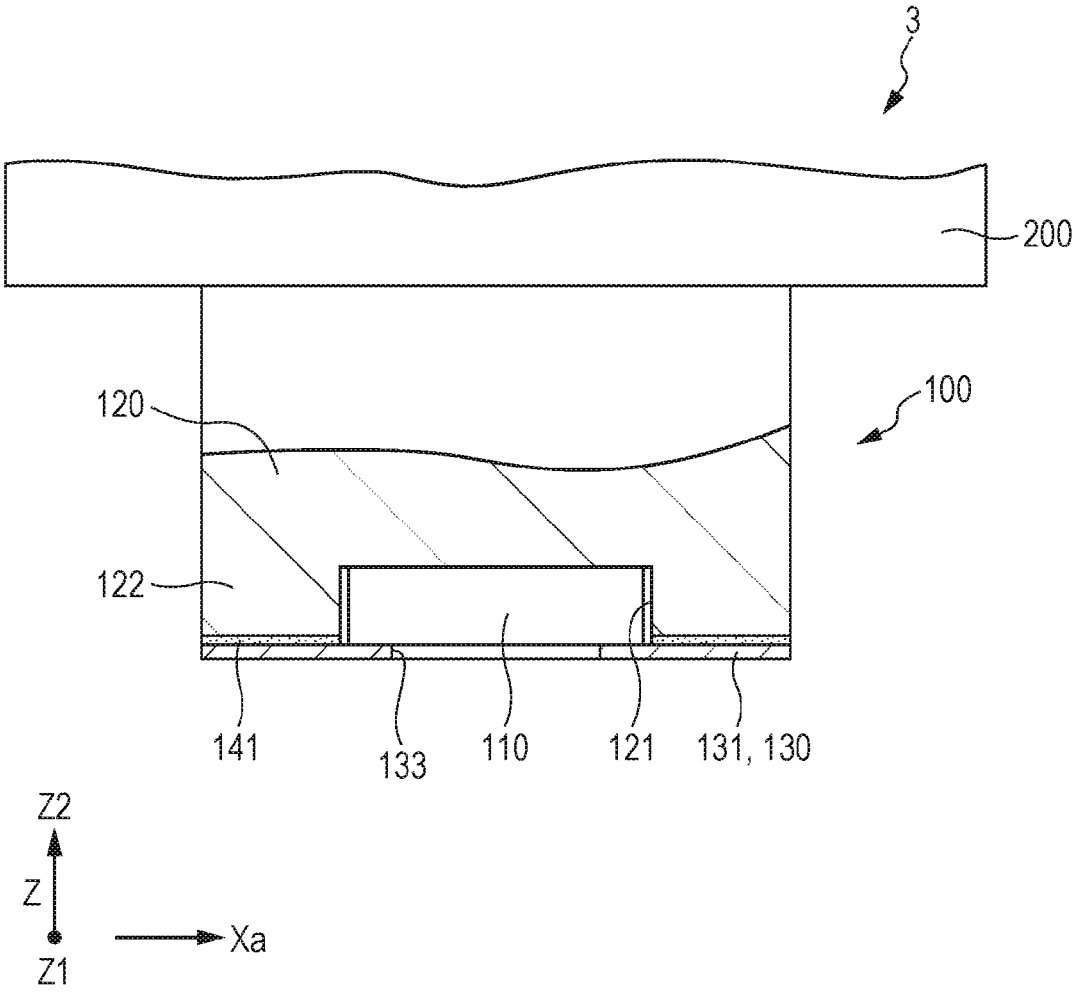
FIG. 5 is a cross-sectional view of the head unit according to Embodiment 1 of the invention.

Here, the head unit 3 which is mounted on the ink jet type recording apparatus 1 will be further described in detail with reference to FIGS. 2 to 5. In addition, FIG. 2 is an exploded perspective view illustrating the ink jet type recording head unit which is an example of the liquid ejecting head unit according to Embodiment 1 of the invention. FIG. 3 is a plan view of the liquid ejecting surface side of the ink jet type recording head unit. FIGS. 4A and 4B are a cross-sectional view which cuts out a main part along line IV-IV in FIG. 3 and an enlarged view of the main part, respectively. FIG. 5 is a cross-sectional view which cuts out the main part along line V-V in FIG. 3.

As illustrated in the drawings, the head unit 3 of the embodiment includes the plurality of ink jet type recording heads 100 and the head fixing substrate 200 which maintains the plurality of ink jet type recording heads 100.

The ink jet type recording head 100 has a liquid ejecting surface 20*a* provided with a nozzle opening 21 at the Z1 side of the third direction Z.

The ink jet type recording head 100 is fixed at the surface side facing the recording sheet S of the head fixing substrate 200, that is, the Z1 side which is the recording sheet S side of the third direction Z.

As described above, the plurality of ink jet type recording heads 100 is fixed to the head fixing substrate 200 provided in parallel on the straight line in the second direction Y perpendicular to the first direction X which is the transporting direction. In other words, the plurality of ink jet type recording heads 100 is not disposed to be shifted in the first direction X. Accordingly, it is possible to narrow the width of the head unit 3 in the first direction X, and to make the head unit 3 small. Obviously, the ink jet type recording heads 100 provided in parallel in the second direction Y may be disposed to be shifted in the first direction X, but when the ink jet type recording head 100 is largely shifted in the first direction X, the width of the head fixing substrate 200 or the like in the first direction X increases. In this manner, when the size of the head unit 3 in the first direction X becomes large, a distance between the first transporting roller 5 and the second transporting roller 6 in the first direction X in the ink jet type recording apparatus 1 increases, and it is difficult to fix the posture of the recording sheet S. In addition, the size of the head unit 3 and the ink jet type recording apparatus 1 becomes large.

In addition, in the embodiment, the four ink jet type recording heads 100 are fixed to the head fixing substrate 200. However, if the number of the ink jet type recording heads 100 is two or more, the number is not particularly limited.

Here, an example of the ink jet type recording head mounted on the head unit will be described in detail.

As illustrated in the drawings, the ink jet type recording head 100 includes: a plurality of head main bodies 110; a holder 120 which is a maintaining member of the embodiment that maintains the plurality of head main bodies 110; and a cover 130 provided at the liquid ejecting surface 20*a* side of the head main body 110.

The head main body 110 has the liquid ejecting surface 20*a* provided with the nozzle opening 21 at the Z1 side of the third direction Z. In addition, a Z2 side of the plurality of head main bodies 110 is adhered to a surface of the Z1 side of the holder 120.

The holder 120 has a maintaining portion 121 which forms a space in a groove shape at the Z1 side. As the maintaining portion 121 is provided to be continued across the second direction Y on the surface of the Z1 side of the holder 120, the maintaining portion 121 is provided to be opened on both side surfaces of the second direction Y. In addition, in the holder 120, as the maintaining portion 121 is provided at a substantial center part of the first direction X, leg portions 122 are formed at both sides of the maintaining portion 121 in the first direction X. In other words, the leg portions 122 are provided only at both end portions in the first direction X on the surface of the Z1 side of the holder 120, and are not provided at both end portions in the second direction Y.

The plurality of head main bodies 110 is adhered to the inside of the maintaining portion 121 by an adhesive 140. In other words, the leg portions 122 are disposed at both sides in the first direction X with respect to the head main body 110. In addition, a surface of the holder 120 and a surface of the head main body 110 which are facing each other in the third direction Z are adhered to each other by the adhesive 140. In addition, in the inside (not illustrated) of the holder 120, the flow path or the like which supplies the ink to the head main body 110 is provided, and a flow path of the holder 120 and a flow path of the head main body 110 communicate with each other to be sealed by the adhesive 140. In addition, the holder 120 may have a configuration in which a plurality of members is stacked in the third direction Z.

Here, the head main body 110, which will be described later in detail, has a configuration in which the plurality of members is stacked. In the plurality of head main bodies 110, irregularity in height in the third direction Z occurs according to dimension tolerance of the plurality of members which constitutes each of the head main bodies 110 and irregularity in thickness of the adhesive or the like which stacks the plurality of members. In order to maintain the plurality of head main bodies 110 in which the irregularity in height in the third direction Z occurs by the common holder 120 and to arrange the liquid ejecting surface 20*a* of the plurality of head main bodies 110 on a plane surface, that is, in order to arrange the height of the liquid ejecting surface 20*a* in the third direction Z, it is required to accommodate the irregularity in height of the head main bodies 110 by the adhesive 140 which adheres the holder 120 and the head main bodies 110 to each other. In this manner, it is preferable that an adhesive having relatively high viscosity be used as the adhesive 140 which accommodates the irregularity in height of the head main bodies 110. Even when the adhesive 140 is an adhesive having relatively high viscosity, there is a problem in that the moisture included in the ink evaporates from the adhesive 140 which adheres the holder 120 and the head main bodies 110 to each other. Even when only one head main body 110 is provided, there is a concern that the moisture included in the ink evaporates from the adhesive 140 which adheres the head main body 110 and the holder 120 to each other. In other words, even when the irregularity in height is not accommodated by the adhesive 140 which adheres the head main body 110 and the holder 120 to each other, there is a concern that the moisture evaporates from the adhesive 140 which adheres the head main body 110 and the holder 120 to each other.

It can be also considered to fix the holder 120 and the head main body 110 with a screw or the like. However, the size of the head main body 110 is small, and in the embodiment, since the plurality of the head main bodies 110 is required to be attached with respect to one holder 120, it is difficult to fix the head main body 110 with a screw or the like via a seal member made of an elastic material. Therefore, by adhering the head main body 110 and the holder 120 to each other by the adhesive 140, it is possible to reduce the cost by reducing the number of components and to seal the flow path which is connected to both of the head main body 110 and the holder 120 without providing the seal member or the like made of the elastic material therebetween.

In addition, the plurality of head main bodies 110 is adhered to the inside of the maintaining portion 121 of the holder 120 to be provided in parallel in the second direction Y. In the embodiment, six head main bodies 110 are adhered to one holder 120. The number of the head main bodies 110 fixed to one holder 120 is not limited to the above-described number. The number of the head main body 110 with respect to one holder 120 may be one, or may be two or more. By providing the plurality of head main bodies 110 with respect to one ink jet type recording head 100 and making a plurality of nozzle rows, it is possible to improve yield, compared to a case where the plurality of nozzle rows is provided only to one head main body 110 with respect to one ink jet type recording head 100. In other words, by making the plurality of nozzle rows in one head main body 110, the yield of the head main body 110 decreases and the manufacturing cost increases. In contrast to this, by fixing the plurality of head main bodies 110 to the common holder 120 and making the plurality of nozzle rows by the plurality of head main bodies 110, it is possible to improve the yield of the head main body 110 and to reduce the manufacturing cost.

In addition, the plurality of head main bodies 110 of the embodiment is fixed so that the nozzle rows are inclined with respect to the first direction X which is the transporting direction of the recording sheet S, in the in-plane direction of the liquid ejecting surface 20*a*. In other words, with respect to the first direction X, a fourth direction Xa, which is a direction in which the nozzle openings 21 are provided in parallel that constitutes the nozzle row, is inclined. In the embodiment, in the ink jet type recording head 100, the plurality of head main bodies 110 is provided in parallel in the second direction Y, and the ink jet type recording head 100 can be disposed at a position where at least parts of the nozzle openings 21 of the adjacent head main bodies 110 in the second direction Y are overlapped with each other in the first direction X. In addition, the plurality of ink jet type recording heads 100 is provided in parallel in the second direction Y, and can be disposed at a position where at least parts of the nozzle openings 21 of the adjacent ink jet type recording head 100 in the second direction Y are overlapped with each other in the first direction X. Accordingly, it is possible to form the nozzle openings 21 which are provided in parallel at a similar interval in the second direction Y of the head unit 3.

The cover 130 corresponds to a fixing board of the embodiment, and is made of a board-shaped member, such as metal. The cover 130 is provided at the liquid ejecting surface 20*a* side of the ink jet type recording head 100, that is, at the Z1 side of the third direction Z of the ink jet type recording head 100.

The cover 130 is formed by bending a member in a flat board shape, and includes a base portion 131 provided at the liquid ejecting surface 20*a* side and a bending portion 132 in which both end portions of the base portion 131 in the second direction Y are provided to be curved to the Z2 side of the third direction Z.

As illustrated in FIG. 5, the base portion 131 is bonded to the surface of the Z1 side of the holder 120 in the third direction Z, that is, to an end surface of the Z1 side of the leg portions 122 via an adhesive 141.

In addition, as illustrated in FIGS. 4A and 4B, an exposure opening portion 133 for opening the nozzle openings 21 of each of the head main bodies 110 is provided in the base portion 131. In the embodiment, the exposure opening portion 133 is provided to be independently opened for every head main body 110. In other words, since the ink jet type recording head 100 of the embodiment has six head main bodies 110, six independent exposure opening portion 133 are provided in the base portion 131. According to the configuration of the head main body 110 or the like, one common exposure opening portion 133 may be provided with respect to a head main body group which is configured to have the plurality of head main bodies 110.

In addition, in the embodiment, since the leg portions 122 are not provided in the second direction Y of the maintaining portion 121, the exposure opening portion 133 is provided to the vicinity of the bending portion 132 in the second direction Y. In other words, the interval from the entire circumference of the base portion 131 to the exposure opening portion 133 becomes smaller in the second direction Y than in the first direction X.

The Z1 side of the maintaining portion 121 of the holder 120 is covered by the base portion 131.

In addition, the bending portion 132 is provided at both end portions of the base portion 131 in the second direction Y, and is formed at a size that can cover the area of the opening which is opened to the side surface of the maintaining portion 121 in the second direction Y. In other words, the bending portion 132 is an area from the end portion of the base portion 131 in the second direction Y to an edge portion of the cover 130. The bending portion 132 is bonded to the side surface of the holder 120 in the second direction Y via the adhesive 141. Accordingly, the opening to the side surface of the maintaining portion 121 in the second direction Y is sealed to be covered by the bending portion 132.

In other words, between the holder 120 and the cover 130, the end surface of the leg portions 122 in the third direction Z and the base portion 131 are adhered to each other by the adhesive 141 at both sides of the first direction X, and the opened side surface of the maintaining portion 121 and the bending portion 132 are adhered to each other at both sides of the second direction Y via the adhesive 141. Accordingly, the head main body 110 is disposed in the maintaining portion 121 which is the space between the holder 120 and the cover 130. In other words, the adhesive 140 which adheres the head main body 110 and the holder 120 to each other is included in the maintaining portion 121 which is the space formed by adhering the holder 120 and the cover 130 by the adhesive 141. Therefore, even when the adhesive 140 which is likely to allow permeation of the moisture included in the ink as the adhesive 140 which adheres the holder 120 and the head main body 110 to each other is used, the inside of the maintaining portion 121 is sealed by the adhesive 141 which adheres the holder 120 and the cover 130, and thus it is possible to suppress the evaporation of the moisture included in the ink. In addition, in order to seal the inside of the maintaining portion 121, it is preferable to adhere the base portion 131 of the cover 130 and the liquid ejecting surface 20*a* side of the head main body 110 to each other. In other words, it is appropriate that the vicinity of the exposure opening portion 133 is adhered to the head main body 110 so that the moisture does not evaporate to the outside via the exposure opening portion 133. In addition, it is appropriate that the adhesive 141, which adheres the holder 120 and the cover 130 to each other, adheres the holder 120 and the head main body 110, and is unlikely to allow permeation of the moisture as opposed to the adhesive 140 which accommodates the irregularity in height of the head main body 110.

In this manner, in the embodiment, at both sides of the holder 120 in the second direction Y, by providing the bending portion 132 in the cover 130, the cover 130 and the holder 120 are adhered to each other. Accordingly, at both sides of the holder 120 in the second direction Y, the leg portions to be adhered to the base portion 131 of the cover 130 are not required. For this reason, when the ink jet type recording head 100 is provided in parallel in the second direction Y, the leg portions do not exist at a side between the adjacent ink jet type recording heads 100. Therefore, it is possible to narrow the interval between the adjacent ink jet type recording heads 100 in the second direction Y. Accordingly, it is possible to provide the head main bodies 110 of the adjacent ink jet type recording heads 100 to be close to each other in the second direction Y, and to provide the nozzle openings 21 provided in each of the head main bodies 110 of the adjacent ink jet type recording heads to be close to each other in the second direction Y.

In order to suppress evaporation of the moisture included in the ink without providing the bending portion 132 which is adhered to the holder 120 at both sides of the cover 130 in the second direction Y, it is required to provide the leg portions at both sides of the holder 120 in the second direction Y, and to adhere the end surface of the Z1 side of the leg portions and the base portion 131 to each other. In other words, it is required to provide the maintaining portion 121 to be opened only to the Z1 side of the third direction Z. In this manner, when the leg portions are provided at both sides of the second direction Y, the interval between the maintaining portions 121 of the adjacent ink jet type recording heads 100 widens, and it is not possible to provide the head main bodies 110 of the adjacent ink jet type recording heads 100 to be close to each other, and thus, the nozzle openings 21 are disposed to be separated in the second direction Y. In other words, in order to provide the ink jet type recording heads 100 adjacent to each other and to provide the head main bodies 110 of the ink jet type recording heads 100 to be close to each other, the leg portions 122 may not be provided at both sides of the second direction Y which is the direction in which the ink jet type recording heads 100 are provided in parallel. Here, the maintaining portion 121 is provided with the opening, which communicates with the space where the head main bodies 110 are disposed, at both side surfaces of the second direction Y. In addition, in the configuration, when the cover 130 adheres only to the end surface of the Z1 side of the leg portions 122 of the holder 120, the inside of the maintaining portion 121 is opened to the outside on both side surfaces of the second direction Y, and the moisture which permeates the adhesive 140 that adheres the holder 120 and the head main bodies 110 to each other evaporates to the outside.

In the embodiment, by sealing the maintaining portion 121 which is opened to both side surfaces of the second direction Y for providing the head main bodies 110 to be close to each other by the bending portion 132 of the cover 130, without providing the leg portions at both sides of the second direction Y, it is possible to narrow the interval of the adjacent ink jet type recording heads 100 in the second direction Y, to provide the nozzle openings 21 of the adjacent ink jet type recording heads 100 to be close to each other, and to suppress evaporation of the moisture which permeates the adhesive 140 that adheres the head main bodies 110 and the holder 120 to each other.

In addition, in the embodiment, a concave portion 123 is provided on the side surface of the holder 120 in the second direction Y, and the bending portion 132 is adhered to the inside of the concave portion 123. The concave portion 123 is provided to be opened to both side surfaces of the second direction Y and to be opened to the surface of the Z1 side in the third direction Z. As the concave portion 123 is provided in the holder 120, the bending portion 132 is inserted and adhered to the inside of the concave portion 123. For this reason, it is possible to easily adhere the holder 120 and the bending portion 132 of the cover 130 to each other. In other words, by providing the concave portion 123 in the holder 120, a space between the holder 120 and the bending portion 132 of the cover 130 is filled with the adhesive 141 by a capillary force only by coating the adhesive 141 between the end portion of the bending portion 132 of the cover 130 which is inserted into the 123 and the concave portion 123. For this reason, it is not required to perform a process in which the adhesive 141 is coated on a surface which does not have the concave portion 123 and faces a different direction along the end portion of the bending portion 132 with respect to a gap between the holder 120 and the bending portion 132, and thus it is possible to simplify the adhesion process. In addition, in the embodiment, by providing the concave portion 123 in the holder 120, a protrusion amount of the bending portion 132 of the cover 130 in the second direction Y can be small, the interval of the adjacent ink jet type recording heads 100 in the second direction Y can further narrow, and the interval of the nozzle openings 21 of the adjacent ink jet type recording heads 100 can further narrow. In addition, by providing the concave portion 123 in the holder 120 and inserting the bending portion 132 into the concave portion 123, even when an irregularity in bending angle of the bending portion 132 occurs, it is possible to make the protrusion amount of the bending portion 132 in the second direction Y small. For this reason, it is possible to suppress interference of the bending portion 132 in the adjacent ink jet type recording heads 100. Accordingly, it is possible to narrow the interval between the ink jet type recording heads 100 adjacent to each other.

In this manner, in the head unit 3 of the embodiment, when the plurality of ink jet type recording heads 100 which suppresses evaporation of the moisture of the ink is provided in parallel in the head fixing substrate 200 in the second direction Y, it is possible to narrow the interval between the ink jet type recording heads 100 adjacent to each other in the second direction Y. For this reason, it is possible to narrow the interval of the nozzle openings 21 of the adjacent ink jet type recording heads 100. In addition, since the interval of the nozzle openings 21 of the adjacent ink jet type recording heads 100 can narrow, it is possible to provide the plurality of ink jet type recording heads 100 in parallel on the straight line which extends in the second direction Y, and to make the width of the head unit 3 in the first direction X small. In other words, when the ink jet type recording heads 100 cannot be provided to be close to each other in the second direction Y if the ink jet type recording heads 100 are provided in parallel on the straight line in the second direction Y, in order to provide the nozzle openings 21 of the adjacent ink jet type recording heads 100 in the second direction Y to be close to each other in the second direction Y, it is required to dispose each of the ink jet type recording heads 100 in zigzags in the second direction Y. Here, disposing the ink jet type recording heads 100 in zigzags in the second direction Y means disposing the ink jet type recording heads 100 provided in parallel in the second direction Y to be alternately shifted in the first direction X, and providing two rows of the ink jet type recording heads 100 provided in parallel in the second direction Y in parallel in the first direction X. In this manner, when the ink jet type recording heads 100 are disposed in zigzags, the width of the head unit 3 in the first direction X increases. In addition, when the width of the head unit 3 increases in the first direction X, the distance between the first transporting roller 5 and the second transporting roller 6 in the first direction X in the ink jet type recording apparatus 1 illustrated in FIG. 1 increases, it is difficult to fix the posture of the recording sheet S, and the head unit 3 and the ink jet type recording apparatus 1 become large.

In the embodiment, since the width of the head unit 3 in the first direction X can be small, it is possible to shorten the distance between the first transporting roller 5 and the second transporting roller 6 in the first direction X, to make it easy to fix the posture of the recording sheet S, and to improve the printing quality. In addition, it is possible to make the head unit 3 and the ink jet type recording apparatus 1 small.

In addition, in the embodiment, both end portions of the base portion 131 in the first direction X are not curved toward the Z2 side, and the leg portions 122 are adhered to the base portion 131 at the liquid ejecting surface 20*a* side. The embodiment is not limited thereto, and for example, both end portions of the base portion 131 in the first direction X may also be bent to the Z2 side similarly to the bending portion 132. Accordingly, it is possible to improve strength of the base portion 131. In addition, as a corner of the ink jet type recording head 100 in the first direction X at the liquid ejecting surface 20*a* side is covered by the cover 130, it is possible to suppress a defect, such as peeling of the cover 130, due to the abutting of the recording sheet S.

In addition, in the embodiment, the leg portions 122 are provided at both sides of the holder 120 in the first direction X, but the leg portions 122 may not be provided. In other words, the head main body 110 may be adhered to the surface of the Z1 side of the holder 120, and the bending portion 132 may be provided at both sides of the cover 130 in the first direction X and the second direction Y. In other words, in the cover 130, the bending portion 132 may be provided across the entire circumference in the in-plane direction of the liquid ejecting surface 20*a*, and the cover 130 may be adhered across the entire circumference of the side surface of the holder 120. Accordingly, it is possible to make the width of the head unit 3 in the first direction X much smaller. In addition, by making the width of the head unit 3 in the first direction X small, it is possible to provide the plurality of head units 3 to be close to each other in the first direction X. However, the cover 130 which has the bending portion 132 across the entire circumference of the base portion 131 requires to be formed by a drawing process. However, in the drawing process, there is a case where the length of the bending portion 132 is not sufficiently ensured and the manufacturing is difficult. In addition, as illustrated in the embodiment, by adhering the end surface of the Z1 side of the leg portions 122 to the base portion 131 of the cover 130, it is possible to improve strength of the ink jet type recording heads 100 in the third direction Z. In addition, by adhering the end surface of the Z1 side of the leg portions 122 to the base portion 131 of the cover 130, it is possible to support the pressure at a time of adhering the cover 130 and the holder 120 to each other by the leg portions 122, and to suppress a destruction of the head main body 110 or the like by suppressing the pressure directly applied to the head main body 110.

In addition, in the embodiment, the leg portions 122 are not provided at both sides of the holder 120 in the second direction Y. However, by providing the leg portions 122 at both sides of the second direction Y, it is possible to improve strength of the ink jet type recording head 100 in the third direction Z. In this case, the length of the end surface of the Z1 side in the first direction X of the leg portions 122 provided at both sides of the first direction X is shorter than the length of the end surface of the Z1 side in the second direction Y of the leg portions 122 provided at both sides of the second direction Y. Accordingly, it is possible to narrow the interval of the ink jet type recording heads 100 adjacent to each other in the second direction Y. In addition, in this case, at both sides of the second direction Y, by adhering the bending portion 132 and the side surface of the holder 120 to each other by the adhesive 141, it is possible to ensure an area which is required to adhere the cover 130 on the side surface of the holder 120, and to effectively suppress evaporation of the moisture.

As illustrated in FIG. 3, when viewed from the liquid ejecting surface 20*a* side in a planar view, the ink jet type recording head 100 of the embodiment has a shape which is a substantial parallelogram. As described above, this is because the fourth direction Xa, which is a direction in which the nozzle openings 21 that constitute the nozzle rows of each of the head main bodies 110 are provided in parallel, is provided to be inclined with respect to the first direction X which is the transporting direction of the recording sheet S, and an external shape of the ink jet type recording head 100 is formed to be a substantial parallelogram in the fourth direction Xa which is the direction in which the nozzle rows are inclined. The shape when viewed from the liquid ejecting surface 20*a* side of the ink jet type recording head 100 in a planar view is not limited to the substantial parallelogram, and the shape may be rectangular, trapezoidal, or polygonal.

By disposing the plurality of ink jet type recording heads 100 and setting as the ink jet type recording head unit 3, effects, such as improved yield in manufacturing, easy process, or easy flattening of the plane surface of the cover 130 which is the fixing board, can be achieved.

Figure 6:
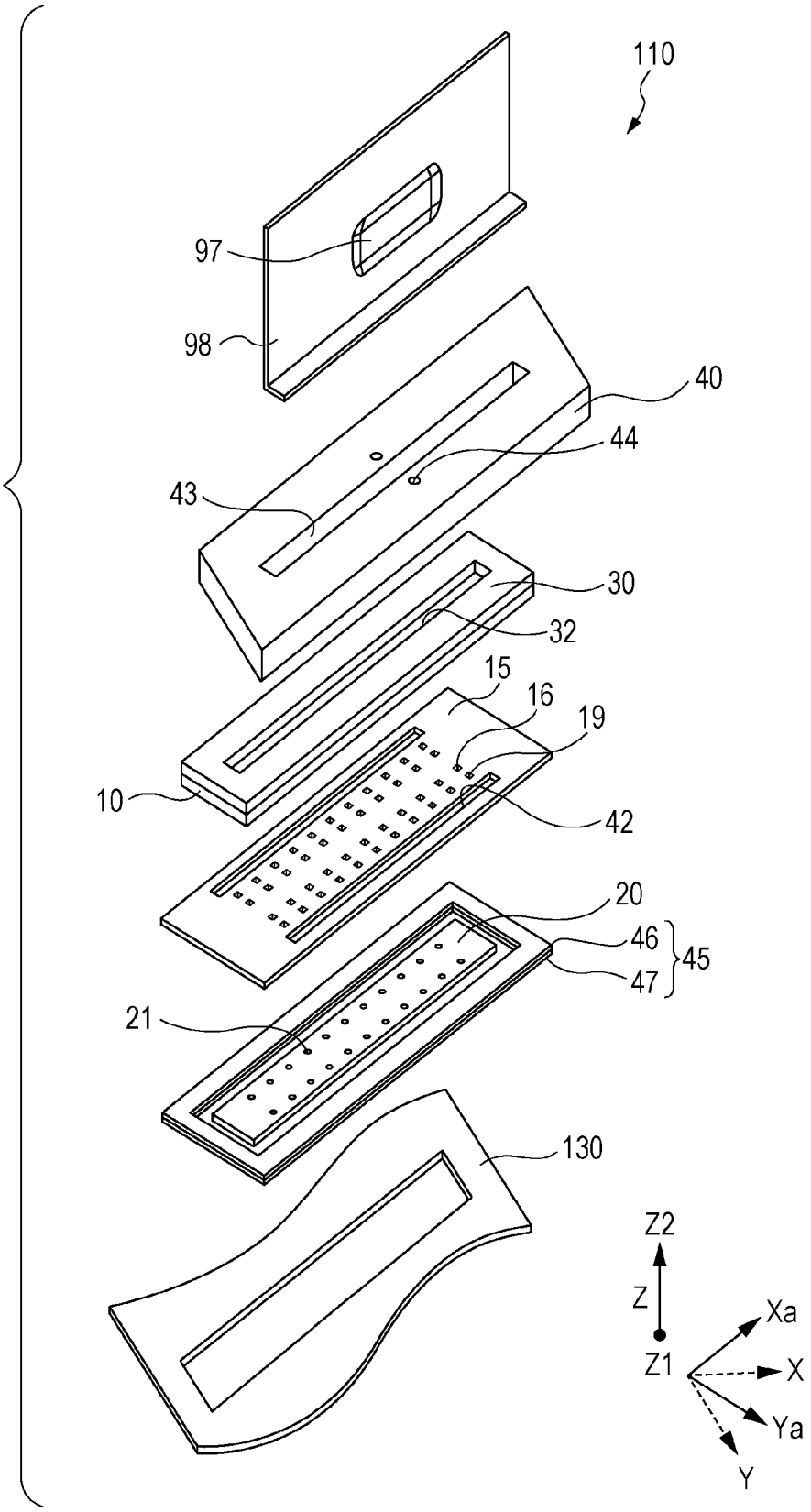
FIG. 6 is an exploded perspective view of a head main body according to Embodiment 1 of the invention.
Figure 7:
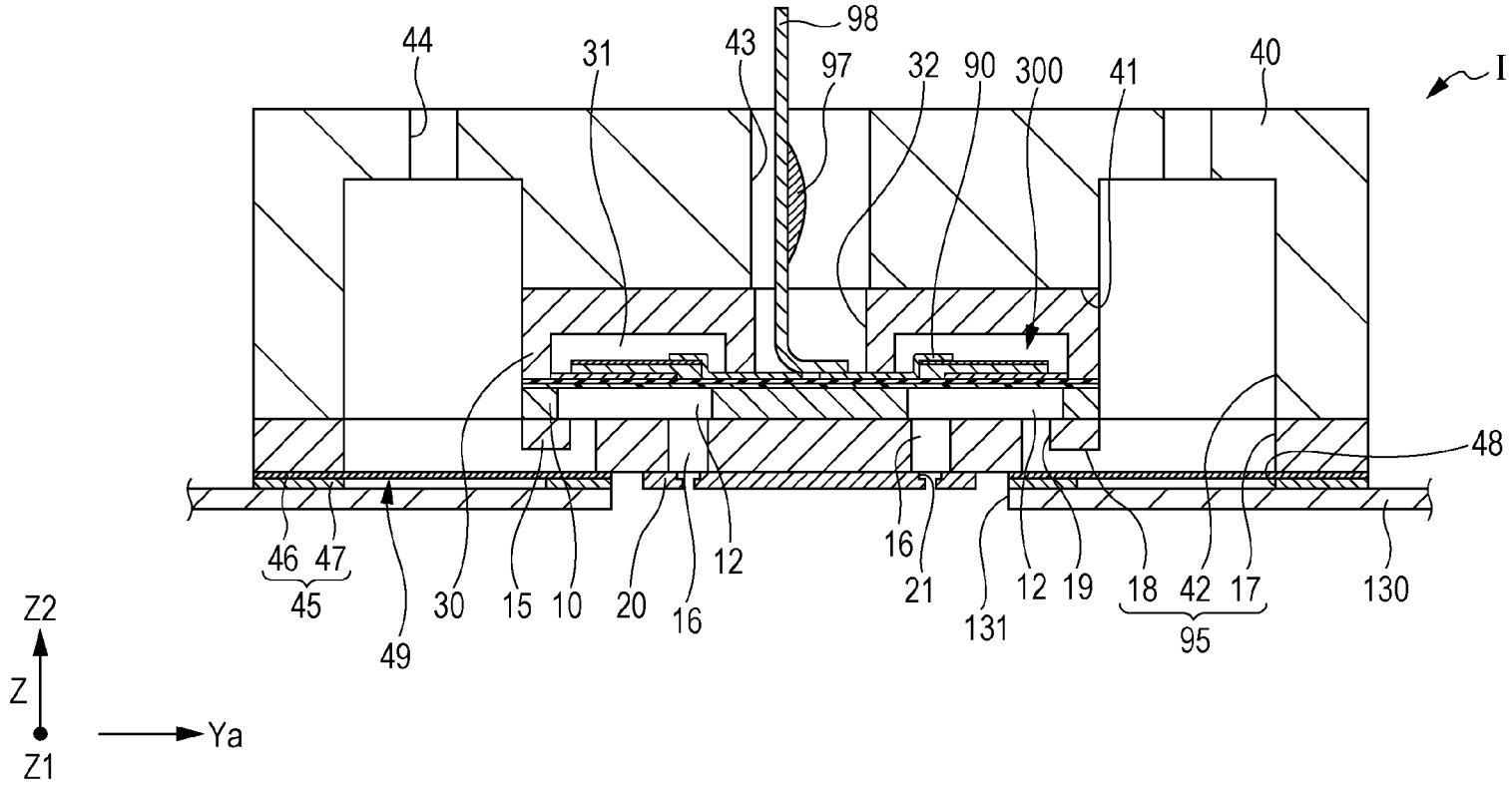
FIG. 7 is a cross-sectional view of the head main body according to Embodiment 1 of the invention.

In addition, hereinafter, an example of the head main body 110 of the ink jet type recording head 100 will be described in detail, but the configuration of the head main body 110 is not limited to the configuration described below. FIG. 6 is a perspective view of the head main body according to Embodiment 1 of the invention. FIG. 7 is a cross-sectional view of the head main body in the second direction Y.

As illustrated in the drawings, the head main body 110 of the embodiment has the plurality of members, such as a flow path forming substrate 10, a communication board 15, a nozzle plate 20, a protection substrate 30, a compliance substrate 45, or a case 40, and the plurality of members are bonded by the adhesive or the like.

As illustrated in the drawings, by performing anisotropic etching from one surface side, on the flow path forming substrate 10 which constitutes the head main body 110, a pressure generation chamber 12 defined by a plurality of partitions is provided in parallel along the direction in which the plurality of nozzle openings 21 is provided in parallel. In addition, in the embodiment, the direction in which the pressure generation chambers 12 are provided in parallel matches with the fourth direction Xa, and on the flow path forming substrate 10, a plurality of rows, in the embodiment, two rows in which the pressure generation chambers 12 are provided in parallel in the fourth direction Xa are provided. The direction, in which the plurality of pressure generation chambers 12 rows formed by the pressure generation chambers 12 provided in the fourth direction Xa is provided, is called a fifth direction Ya, hereinafter. In addition, in the embodiment, the direction perpendicular to the fourth direction Xa and the fifth direction Ya matches with the third direction Z. In addition, the head main bodies 110 of the embodiment is mounted on the head unit 3 so that the fourth direction Xa in which the nozzle openings 21 are provided in parallel is a direction which is inclined with respect to the first direction X that is the transporting direction of the recording sheet S.

In addition, on the flow path forming substrate 10, at one end portion side of the pressure generation chamber 12 in the fifth direction Ya, the opening area may be smaller than the pressure generation chamber 12, and a supply path which imparts a flow path resistance of the ink which flows into the pressure generation chamber 12 or the like may be provided.

In addition, as illustrated in FIG. 6, the communication board 15 is bonded to one surface side of the flow path forming substrate 10. In addition, the nozzle plate 20, in which the plurality of nozzle openings 21 that communicates with each of the pressure generation chambers 12 is punched, is bonded to the communication board 15. In the embodiment, the Z1 side, which is one surface of the third direction Z in which the nozzle openings 21 of the nozzle plate 20 are opened, is the liquid ejecting surface 20*a*.

On the communication board 15, a nozzle communication path 16, which communicates with the pressure generation chambers 12 and the nozzle openings 21, is provided. The communication board 15 has an area greater than the flow path forming substrate 10, and the nozzle plate 20 has an area less than the flow path forming substrate 10. In this manner, by making the area of the nozzle plate 20 relatively small, it is possible to reduce the cost.

In addition, as illustrated in the drawings, on the communication board 15, a first manifold portion 17 and a second manifold portion 18 which constitute a part of a manifold 95 are provided.

The first manifold portion 17 is provided to penetrate the communication board 15 in the third direction Z.

In addition, the second manifold portion 18 does not penetrate the communication board 15 in the third direction Z, and is provided in the middle of the third direction Z to be opened to the nozzle plate 20 side of the communication board 15.

Furthermore, on the communication board 15, a supply communication path 19, which communicates with one end portion of the pressure generation chamber 12 in the second direction Y, is independently provided for every pressure generation chamber 12. The supply communication path 19 communicates with the second manifold portion 18 and the pressure generation chamber 12.

On the nozzle plate 20, the nozzle openings 21 which communicate with each of the pressure generation chambers 12 via the nozzle communication path 16 are formed. In other words, in the nozzle openings 21, openings which eject the ink that is the same type of liquid are provided in parallel in the fourth direction Xa, and two rows in which the nozzle openings 21 are provided in parallel in the fourth direction Xa are formed in the fifth direction Ya.

Meanwhile, at a surface side opposite to the communication board 15 of the flow path forming substrate 10, a diaphragm is formed. In addition, on the diaphragm, by sequentially stacking a first electrode, a piezoelectric layer, and a second electrode, a piezoelectric actuator 300 which is a pressure generation section of the embodiment is configured. In general, any one electrode of the piezoelectric actuator 300 is a common electrode, and the other electrode and the piezoelectric layer are patterned for every pressure generation chamber 12.

In addition, the protection substrate 30 which has substantially the same size as the flow path forming substrate 10 is bonded to a surface of the piezoelectric actuator 300 side of the flow path forming substrate 10. The protection substrate 30 has a maintaining portion 31 which is a space for protecting the piezoelectric actuator 300. In addition, a through-hole 32 which penetrates in the third direction Z is provided on the protection substrate 30. An end portion of a lead electrode 90 derived from the electrode of the piezoelectric actuator 300 extends to be exposed to the inside of the through-hole 32, and the lead electrode and a wiring substrate 98 which has a driving circuit 97, such as a driving IC, mounted thereon are electrically connected to each other inside the through-hole 32.

In addition, the case 40, which defines the manifold 95 that communicates with the plurality of pressure generation chambers 12, is fixed to the protection substrate 30 and the communication board 15. The case 40 has a shape which is substantially the same as the communication board 15 described above in a planar view, is bonded to the protection substrate 30, and is bonded even to the communication board 15 described above. In particular, the case 40 has a concave portion 41 which has a depth to accommodate the flow path forming substrate 10 at the protection substrate 30 side and the protection substrate 30. The concave portion 41 has an opening area which is wider than a surface which is bonded to the flow path forming substrate 10 of the protection substrate 30. An opening surface of the nozzle plate 20 side of the concave portion 41 in a state where the flow path forming substrate 10 or the like is accommodated in the concave portion 41, is sealed by the communication board 15. Accordingly, in the outer circumferential portion of the flow path forming substrate 10, a third manifold portion 42 is defined by the case 40, the flow path forming substrate 10, and the protection substrate 30. The manifold 95 of the embodiment is configured by the third manifold portion 42, and the first manifold portion 17 and the second manifold portion 18 which are provided on the communication board 15.

In addition, the compliance substrate 45 is provided on a surface on which the first manifold portion 17 and the second manifold portion 18 of the communication board 15 are opened. The compliance substrate 45 seals the opening of the first manifold portion 17 and the second manifold portion 18.

In the embodiment, the compliance substrate 45 has a sealing film 46 and a fixed substrate 47. The sealing film 46 is formed of a thin film having flexibility, for example, polyphenylene sulfide (PPS) or stainless steel (SUS). In addition, the fixed substrate 47 is formed of a hard material, such as metal including stainless steel (SUS). Since an area of the fixed substrate 47 facing the manifold 95 is made of an opening portion 48 which is completely removed in a thickness direction, one surface of the manifold 95 is a compliance portion 49 which is a flexible portion sealed only by the sealing film 46 having flexibility.

In addition, in the embodiment, the cover 130 which is a fixing board is adhered to a surface side opposite to the communication board 15 of the compliance substrate 45. In other words, the exposure opening portion 133 provided in the base portion 131 of the cover 130 has the opening area which is wider than the area of the nozzle plate 20, and exposes the liquid ejecting surface 20*a* of the nozzle plate 20 inside the exposure opening portion 133. The cover 130 is not limited thereto, and for example, the exposure opening portion 133 of the cover 130 may be the opening area which is smaller than an external shape of the nozzle plate 20, and the cover 130 may abut against or be adhered to the liquid ejecting surface 20*a* of the nozzle plate 20. Even when the exposure opening portion 133 of the cover 130 is the opening area which is smaller than the external shape of the nozzle plate 20, the cover 130 and the liquid ejecting surface 20*a* may be provided to be in contact with each other. In other words, a case where the cover 130 is provided at the liquid ejecting surface 20*a* side includes a case where the liquid ejecting surface 20*a* is not in contact or a case where the liquid ejecting surface 20*a* is in contact.

In addition, in the embodiment, the cover 130 is adhered to the fixed substrate 47 of the compliance substrate 45. Accordingly, it is possible to seal the maintaining portion 121 between the cover 130 and the holder 120 as described above, and to suppress evaporation of the moisture of the ink.

In addition, in the case 40, an introducing path 44 for supplying the ink to each of the manifolds 95 by communicating with the manifold 95 is provided. In addition, in the case 40, a connection port 43, which communicates with the through-hole 32 of the protection substrate 30 and in which the wiring substrate 98 is inserted, is provided.

In the head main body 110 having the configuration, when the ink is ejected, the ink is incorporated via the introducing path 44 from a storage section, and the inside of the flow path from the manifold 95 to the nozzle opening 21 is filled with the ink. After that, according to a signal from the driving circuit 97, by applying a voltage to each piezoelectric actuator 300 corresponding to the pressure generation chamber 12, the diaphragm together with the piezoelectric actuator 300 are flexurally deformed. Accordingly, the pressure inside the pressure generation chamber 12 increases, and the ink droplets are ejected from predetermined nozzle openings 21.

Another Embodiment

Above, an embodiment of the invention is described, but a basic configuration of the invention is not limited to the description above.

For example, in the above-described Embodiment 1, the head main body 110 includes the plurality of members, such as the flow path forming substrate 10, the communication board 15, the nozzle plate 20, the protection substrate 30, the compliance substrate 45, or the case 40. However, in order to eject the liquid from the nozzle openings 21 provided on the liquid ejecting surface 20*a*, at least the pressure generation section which generates pressure in the pressure generation chamber 12 that communicates with the nozzle openings 21 and the plurality of pressure generation chambers 12 which is provided with the pressure generation section and provided in parallel along a predetermined direction, may be provided. In other words, in the above-described Embodiment 1, the Z1 side of the holder 120 is adhered to the Z2 side of the head main body 110, and the head main body 110 stacks the case 40 on the most Z2 side. However, the head main body 110 is not required to be adhered to the holder 120 via the case 40, and the head main body 110 may be adhered to the holder 120 without using the case 40.

In addition, in the above-described Embodiment 1, the cover 130 which is a fixing board provided at the liquid ejecting surface 20*a* side of the ink jet type recording head 100 and the nozzle plate 20 provided with the nozzle openings 21 of the head main body 110 are separated, but configuration is not limited thereto. The nozzle plate 20 may be provided to extend to the outside of the head main body 110, and the bending portion 132 may be provided by bending the extended end portion in a Z2 direction. In other words, in this case, the nozzle plate 20 corresponds to the fixing board, and the nozzle plate 20 is adhered to the head main body 110. In other words, a case where the fixing board is provided at the liquid ejecting surface 20*a* side with respect to the head main body 110 includes a case where one surface of the fixing board is the liquid ejecting surface 20*a*. In addition, since the fixing board may be provided at the liquid ejecting surface 20*a* side with respect to the head main body 110, the most liquid ejecting surface 20*a* side may be provided to be protruded. In other words, in above-described Embodiment 1, the liquid ejecting surface 20*a* of the nozzle plate 20 rather than the cover 130 may be provided to be protruded to the Z1 side. Furthermore, another member which is different from the nozzle plate 20 may be provided at the Z1 side rather than the fixing board at the liquid ejecting surface 20*a* side of the ink jet type recording head 100. In addition, when the fixing board is provided at the side opposite to the maintaining member (holder 120) with respect to the head main body 110, the fixing board may be provided on the liquid ejecting surface 20*a* with respect to the head main body 110.

In addition, in the above-described Embodiment 1, the direction, in which the plurality of ink jet type recording heads 100 maintained in the head fixing substrate 200 is provided in parallel, is the second direction Y which is the direction perpendicular to the first direction X that is the transporting direction of the recording sheet S, but the invention is not limited thereto. The head unit, in which the ink jet type recording heads 100 are provided in parallel in a longitudinal direction of the head fixing substrate 200, may be disposed so that an angle in which an alignment direction of the plurality of ink jet type recording heads 100 intersects with the first direction X which is the transporting direction of the recording sheet S, that is, an angle which is smaller than 90 degrees with respect to the first direction X. At that time, in the in-plane direction of the liquid ejecting surface 20*a*, even when the nozzle rows are provided in a direction perpendicular the longitudinal direction of the head fixing substrate 200, by inclining the entire head unit, it is possible to dispose the nozzle rows inclined with respect to the first direction X which is the transporting direction.

Figure 8:
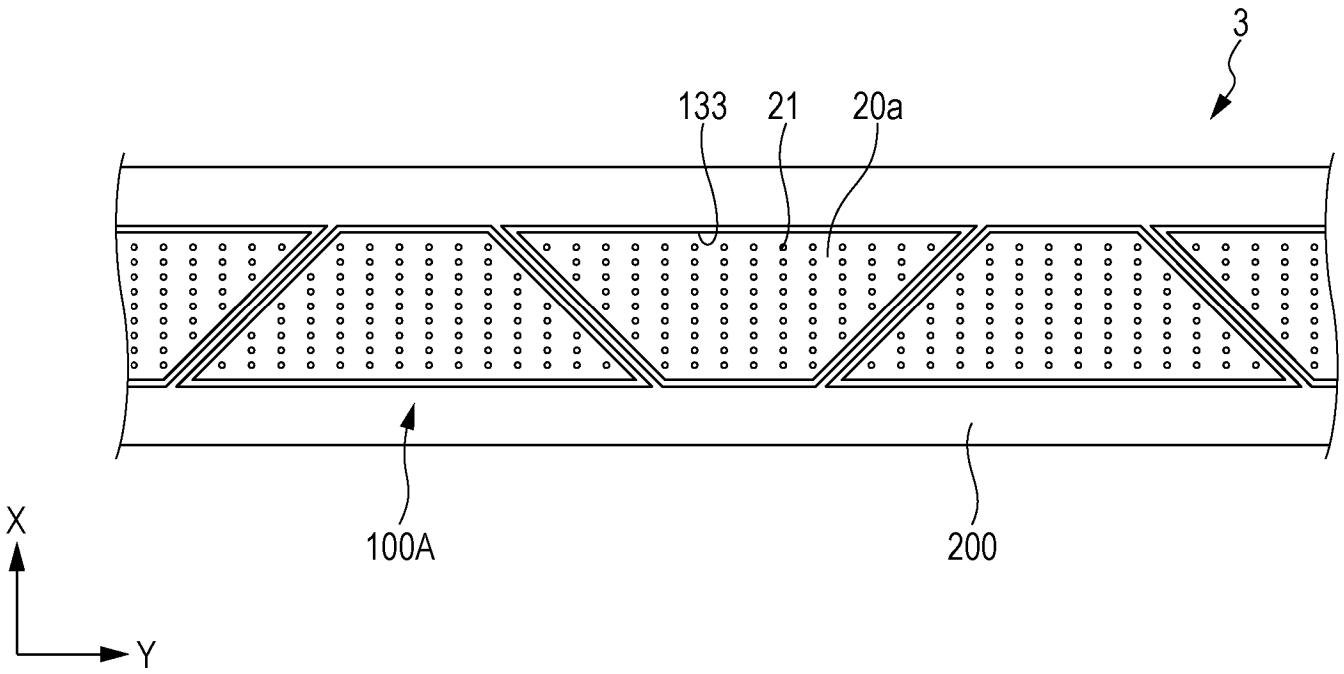
FIG. 8 is a plan view of the head unit according to another embodiment of the invention.

Furthermore, in the above-described Embodiment 1, the fourth direction Xa which is the direction in which the nozzle openings 21 of the head main body 110 are provided in parallel is disposed to be a direction which is inclined with respect to the second direction Y perpendicular to the first direction X which is the transporting direction. However, the fourth direction Xa in which the nozzle openings 21 are provided in parallel may be the same direction as the first direction X which is the transporting direction, and the fourth direction Xa in which the nozzle openings 21 are provided in parallel may be the same direction as the second direction Y. Furthermore, the nozzle openings 21 are not limited to the openings provided in a row form, and the nozzle openings 21 may be disposed in a matrix form. Furthermore, in the above-described Embodiment 1, when viewed in a planar view from the third direction Z perpendicular to the liquid ejecting surface 20*a*, the shape of the holder 120 is a substantial parallelogram, but the shape is not limited thereto, and may be rectangular, trapezoidal, or polygonal. Here, an example is illustrated in FIG. 8. FIG. 8 is a plan view from the liquid ejecting surface side of the ink jet recording head unit which is an example of the liquid ejecting head unit according to another embodiment of the invention.

As illustrated in FIG. 8, an ink jet type recording head 100A has a trapezoidal shape when viewed from the liquid ejecting surface 20*a* side in a planar view. In addition, the plurality of ink jet type recording heads 100A is provided in parallel in the second direction Y and fixed to the head fixing substrate 200, and every other ink jet type recording head 100A provided in parallel in the second direction Y is disposed to be reversed by 180 degrees in the in-plane direction of the liquid ejecting surface 20*a*.

In the ink jet type recording heads 100A, the nozzle openings 21 are disposed in the matrix form on the liquid ejecting surface 20*a*. Even in this configuration, similarly to the above-described Embodiment 1, the bending portion 132 of the cover 130 is adhered to the holder 120 at a side between the adjacent ink jet type recording heads 100A in the second direction Y, and thus it is possible to suppress evaporation of the ink.

Furthermore, in the above-described Embodiment 1, the concave portion 123 is provided in the holder 120, and the bending portion 132 is inserted into the concave portion 123 and adhered by the adhesive 141, but the invention is not particularly limited thereto, and the concave portion 123 may not be provided. In other words, the bending portion 132 may be adhered to the side surface of the holder 120.

In addition, in the above-described Embodiment 1, the leg portions 122 are provided at both sides of the holder 120 in the second direction Y, but the invention is not particularly limited thereto. For example, in the ink jet type recording heads 100 provided in parallel, the ink jet type recording heads 100 of both end portions of the second direction Y which is the parallel direction may not be provided with the leg portion 122 at a side where the adjacent ink jet type recording head 100 exists in the second direction Y, and may be provided with the leg portion 122 at a side where the adjacent ink jet type recording head 100 does not exist in the second direction Y.

Furthermore, in the above-described Embodiment 1, the so-called line type recording apparatus is described as an example of the ink jet type recording apparatus 1 in which the head unit 3 is fixed to the apparatus main body 2 and the printing is performed only by transporting the recording sheet S, but the invention is not particularly limited thereto. It is possible to employ the invention even in a so-called serial type recording apparatus in which the head unit 3 is mounted on a carriage which moves in the second direction Y, for example, the direction which intersects with the first direction X that is the transporting direction of the recording sheet S and the printing is performed while the head unit 3 moves in the direction which intersects with the transporting direction. In addition, the configuration is not limited to the configuration in which the recording sheet S is transported to the head unit 3. The printing may be performed by a configuration in which the head unit 3 moves with respect to the recording sheet S, and the recording sheet S may be relatively transported with respect to the head unit 3.

In addition, in the above-described Embodiment 1, the pressure generation section which causes a pressure change in the pressure generation chamber 12 is described by using the piezoelectric actuator 300 stacked in the third direction Z. However, the piezoelectric actuator 300, for example, may be a thin film type formed by a film forming method or a lithography method, a thick film type formed by a method, such as sticking a green sheet, or the like. In addition, the piezoelectric actuator 300 can be alternately stacked with a piezoelectric material and an electrode forming material, and use a longitudinal vibration type which extends and contracts in an axial direction. In addition, as the pressure generation section, it is possible to use a section which disposes a heating element inside the pressure generation chamber and ejects the liquid droplets from the nozzle openings 21 by bubbles generated by heating the heating element, a so-called an electrostatic actuator which generates static electricity between the diaphragm and the electrode and ejects the liquid droplets from the nozzle openings 21 by deforming the diaphragm according to an electrostatic force, or the like.

What is claimed is:

1. A head unit comprising:

recording heads, each recording head comprising:

a holder provided with flow channels, and head bodies in fluid communication with the flow channels, each head body including a flexible wiring substrate extending towards the holder; and a head fixing substrate, wherein the recording heads are fixed to the head fixing substrate.

2. The liquid ejecting head according to claim 1, wherein a signal reaches each of the head bodies through the flexible wiring substrates, and wherein the holder is provided with connection ports through each of which the flexible wiring substrate extends.

3. The liquid ejecting head according to claim 2, wherein each of the head bodies comprises a case provided with a manifold in communication with the flow channel, and a nozzle plate provided with nozzle openings in communication with the manifold.

4. The liquid ejecting head according to claim 1, wherein each of the recording heads comprises a cover on which the head bodies are stacked, wherein the holder comprises accommodations for the head bodies.

5. The liquid ejecting head according to claim 4, wherein the recording heads are accommodated between the holder and the cover.

6. The liquid ejecting head according to claim 5, wherein each of the head bodies comprises a case provided with a manifold in communication with the flow channel, and a nozzle plate provided with nozzle openings in communication with the manifold.

7. The liquid ejecting head according to claim 4, wherein a gap between the recording heads and the cover is smaller than a gap between the recording heads and the holder.

8. The liquid ejecting head according to claim 7, wherein each of the head bodies comprises a case provided with a manifold in communication with the flow channel, and a nozzle plate provided with nozzle openings in communication with the manifold.

9. The liquid ejecting head according to claim 4, wherein the cover and the holder are fixed to each other by an adhesive.

10. The liquid ejecting head according to claim 9, wherein each of the head bodies comprises a case provided with a manifold in communication with the flow channel, and a nozzle plate provided with nozzle openings in communication with the manifold.

11. The liquid ejecting head according to claim 4, wherein the cover comprises a base portion on which the head bodies are stacked, and bending portions bent from the base portion.

12. The liquid ejecting head according to claim 11, wherein the bending portions are fixed with the holder by an adhesive.

13. The liquid ejecting head according to claim 12, wherein each of the head bodies comprises a case provided with a manifold in communication with the flow channel, and a nozzle plate provided with nozzle openings in communication with the manifold.

14. The liquid ejecting head according to claim 11, wherein the bending portions are aligned in a direction in which the head fixing substrate extends.

15. The liquid ejecting head according to claim 14, wherein each of the head bodies comprises a case provided with a manifold in communication with the flow channel, and a nozzle plate provided with nozzle openings in communication with the manifold.

16. The liquid ejecting head according to claim 11, wherein the bending portions are aligned in a direction in which the recording heads are aligned.

17. The liquid ejecting head according to claim 16, wherein each of the head bodies comprises a case provided with a manifold in communication with the flow channel, and a nozzle plate provided with nozzle openings in communication with the manifold.

18. The liquid ejecting head according to claim 11, wherein the bending portions are aligned in a direction in which the head bodies are aligned.

19. The liquid ejecting head according to claim 11, wherein each of the head bodies comprises a case provided with a manifold in communication with the flow channel, and a nozzle plate provided with nozzle openings in communication with the manifold.

20. The liquid ejecting head according to claim 1, wherein the head bodies of each recording head are arranged along a direction along which the recording heads are arranged.

* * * * *